United States Patent [19]

Kondo et al.

[11] Patent Number: 4,596,226

[45] Date of Patent: Jun. 24, 1986

[54] IGNITION SYSTEM

[75] Inventors: Tadashige Kondo; Naoki Tsuda, both of Tokyo, Japan

[73] Assignee: Kioritz Corporation, Tokyo, Japan

[21] Appl. No.: 739,330

[22] Filed: May 30, 1985

[30] Foreign Application Priority Data

Jun. 11, 1984 [JP] Japan ..... 59-85590[U]

[51] Int. Cl.[4] ..... F02P 3/06

[52] U.S. Cl. ..... 123/602; 123/605

[58] Field of Search ..... 123/418, 427, 599, 602, 123/605, 618; 310/70 R, 70 A, 72, 74; 315/209 SC, 209 CD

[56] References Cited

U.S. PATENT DOCUMENTS 3,952,713 4/1976 Van Siclen, Jr. ..... 315/209 SC X
4,132,208 1/1979 Yukawa ..... 123/602
4,297,977 11/1981 Boyama ..... 123/599 X
4,402,298 9/1983 Morita ..... 123/618 X
4,528,970 7/1985 Fujimoto ..... 123/618 X

FOREIGN PATENT DOCUMENTS 0151060 9/1982 Japan ..... 123/599

*Primary Examiner*—W. R. Wolfe
*Attorney, Agent, or Firm*—Sheridan Neimark

[57] ABSTRACT

An ignition system for an internal combustion engine including a CDI magnet device having a generating coil for charging an ignition capacitor, and an ignition coil having a primary winding which receives a supply of the electric charge discharged by the ignition capacitor through a thyristor, and a signal generating device constituting a circuit for releasing the electric charge of a second capacitor through leak resistors and supplying a signal to a gate of the thyristor when the voltage of the second capacitor reaches a predetermined level.

1 Claim, 4 Drawing Figures

IGNITION SYSTEM

BACKGROUND OF THE INVENTION

This invention relates to an ignition system for an internal combustion engine.

In one type of ignition system for an internal combustion engine known in the art as a CDI system, a magnet is mounted to a rotary member, such as a flywheel, which rotates in synchronism with a rotary shaft of the internal combustion engine and acts on a generating coil to cause same to generate an electromotive force while the flywheel is rotating, the generating coil passing a current to an ignition capacitor to charge same. A trigger voltage for causing a thyristor of an ignition circuit to fire is produced at a predetermined time to cause the ignition capacitor to discharge and cause an ignition coil to generate a high voltage, so that a spark discharge will take place in an ignition plug of the internal combustion engine. The time at which ignition is effected is predetermined at all times regardless of the revolution speed of the internal combustion engine.

Generally, it is desirable, to enable the internal combustion engine to exhibit high performance, that the time at which ignition takes place be delayed in a range of low engine speeds when the engine is started or the engine idles, that the time at which ignition takes place be advanced in a range of high engine speeds, and that the time at which ignition takes place be gradually advanced as the engine speed increases in a range of medium engine speeds. However, in the type of ignition system described hereinabove, the time at which ignition takes place is predetermined irrespective of the revolution speed of the internal combustion engine and the time at which ignition takes place is altered in a monent when a predetermined revolution speed is exceeded. Thus, it has hitherto been impossible for the ignition system of the prior art to meet the aforesaid requirements.

SUMMARY OF THE INVENTION

This invention has been developed for the purpose of obviating the aforesaid disadvantage of the prior art. Accordingly, the invention has as its object the provision of an ignition system capable of altering the time at which ignition takes place depending on the revolution speed of the engine.

The outstanding characteristic of the invention enabling the aforesaid object to be accomplished comprises signal generating means comprising a signal coil, a first capacitor and a second capacitor and constituting a gating circuit of a thyristor. The signal coil supplies a signal to the first capacitor to charge same, and the electric charge stored in the first capacitor is passed through a constant current circuit to the second capacitor to charge same, the second capacitor discharging through leak resistors. When the voltage in the second capacitor reaches a predetermined level, a signal is supplied through transistors to a gate of the thyristor.

The invention enables the time at which ignition takes place to be continuously delayed in the range of low engine speeds, to be advanced in the range of high engine speeds and to be advanced or delayed in the range of medium engine speeds in accordance with an increase or a decrease in the engine speed, to thereby enable the engine to exhibit high performance. The invention facilitates engine startup and stabilizes engine idling while keeping the idling speed at a low level and permitting the time at which ignition takes place to be adjusted in wide range. The arrangement that the spark generating circuit and the ignition time signal generating circuit are independent of each other allows the system to be designed with a certain degree of latitude and readily assembled with the engine.

DESCRIPTION OF THE PREFERRED EMBODIMENT

Figure 1:
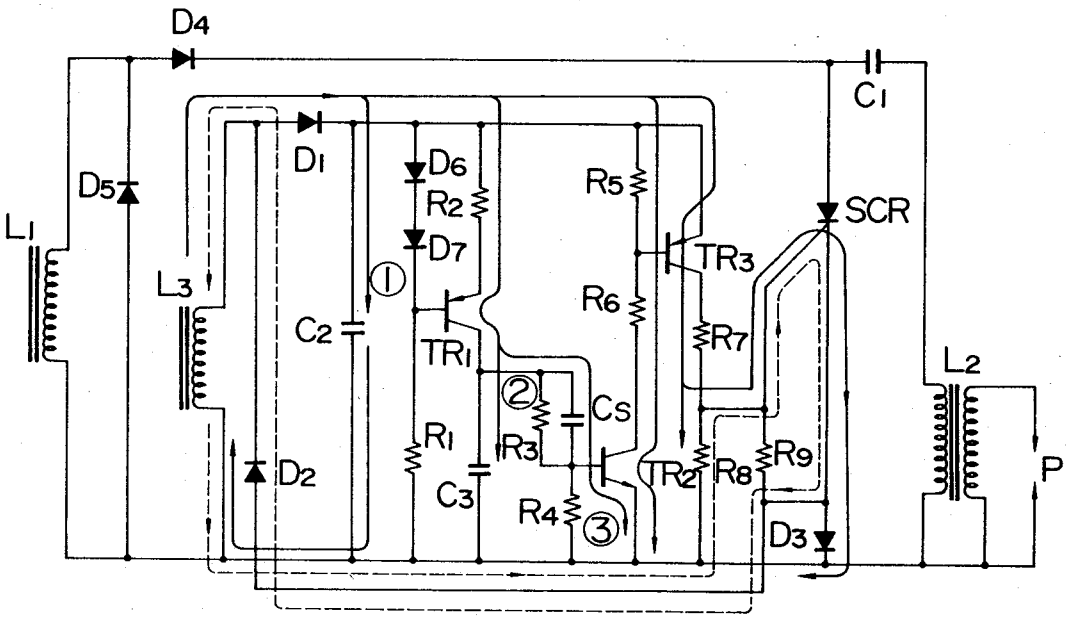
FIG. 1 is a circuit diagram of one embodiment of the ignition system in conformity with the invention.

FIG. 1 shows a preferred embodiment of the ignition system in accordance with the invention which is suitable for use with an internal combustion engine assembled with a chain saw, a mowing apparatus, a chemical agent spreader, etc.

Referring to FIG. 1, $L_1$, $L_2$ and $L_3$ designate a generating coil, an ignition coil and a signal coil, respectively. $C_1$, $C_2$, $C_3$ and $C_s$ designate an ignition capacitor, a first capacitor, a second capacitor and a capacitor, respectively. $D_1$, $D_2$, $D_3$, $D_4$, $D_5$, $D_6$ and $D_7$ designate diodes. $R_1$, $R_2$, $R_3$, $R_4$, $R_5$, $R_6$, $R_7$, $R_8$ and $R_9$ designate resistors. SCR designates a thyristor. $TR_1$, $TR_2$ and $TR_3$ designate transistors. P designates an ignition plug. These elements are connected together as shown in FIG. 1.

Figure 2:
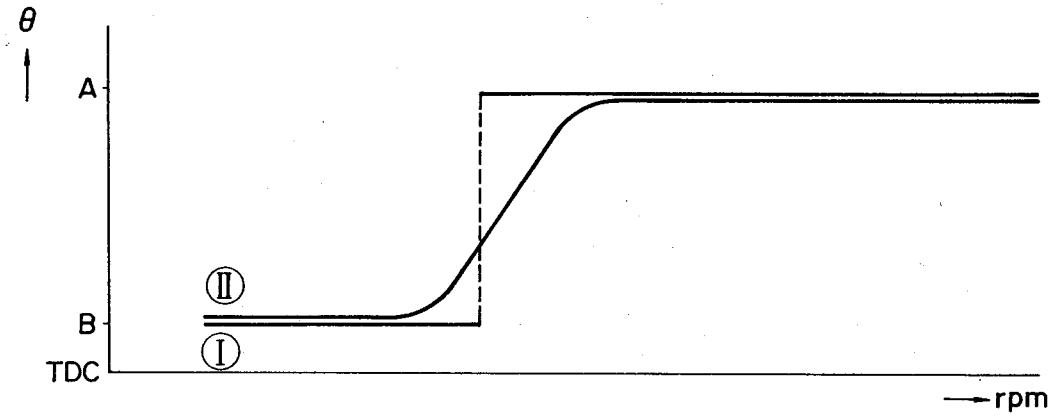
FIG. 2 is a diagrammatic representation of the relation between the time at which ignition takes place and the revolution speed of the engine which is obtained when the ignition system shown in FIG. 1 is used.
Figure 3:
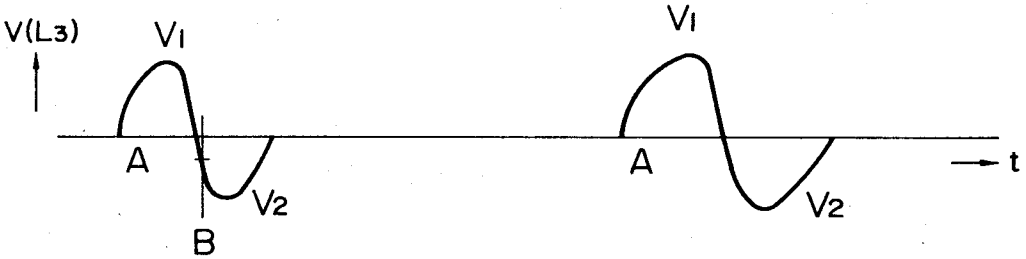
FIG. 3 shows the wave form of the electromotive force generated by the signal coil of the ignition system shown in FIG. 1.

In the ignition system of the aforesaid construction according to the invention, the time at which ignition takes place in the range of high engine speeds or the range of operation rotations is set at a value A (see FIG. 2) which is optimum for this range of engine speeds. The signal coil $L_3$ generates an electromotive force of a wave form shown in FIG. 3.

The generating coil $L_1$ and signal coil $L_3$ are located in the vicinity of the flywheel (not shown) of the internal combustion engine, for example, in such a manner that they are angularly spaced apart from each other, so that a magnet secured to the flywheel successively passes by the coils $L_1$ and $L_3$ during the rotation of the flywheel to cause a voltage to be produced in each of the coils $L_1$ and $L_3$. The wave form of the voltage produced in the signal coil $L_3$ has a polarity which is opposite to that of the voltage produced in the generating coil $L_1$, and the voltage produced in the former is smaller in absolute value than the voltage produced in the latter. The period of time in which the voltage is produced in the signal coil $L_3$ does not coincide with the period of time in which the voltage is produced in the generating coil $L_1$.

Figure 4:
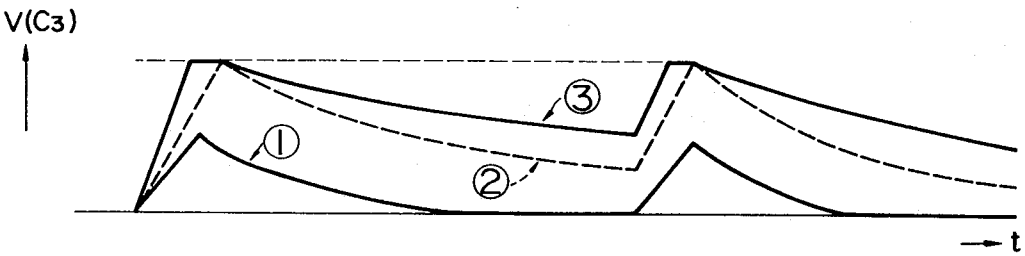
FIG. 4 is a diagram showing changes in the voltage of the second capacitor of the ignition system shown in FIG. 1.

In the range of low engine speeds, the voltage does not reach a level sufficiently high to cause the transistors $TR_2$ and $TR_3$ to conduct, even if an electromotive force $V_1$ of the signal coil $L_3$ charges the second capacitor $C_3$ after it has charged the first capacitor $C_2$. Thus, as electromotive force $V_2$ is generated in the signal coil $L_3$, a current is passed from the signal coil $L_3$ through a gate of the thyristor SCR to its cathode, so as to cause the thyristor SCR to conduct at an ignition timing B shown in FIG. 2. At this time, the voltage of the second capacitor $C_3$ has a wave form ① shown in FIG. 4.

As the engine speed increases, the voltage of the second capacitor $C_3$ rises and the voltage $V_1$ of the signal coil $L_3$ reaches a level high enough to cause the transistor $TR_2$ to conduct, so that the thyristor SCR can be triggered by the energy of the voltage $V_1$. At this time, the voltage of the second capacitor $C_3$ has a wave form ② shown in FIG. 4, and the charging in the next cycle begins to take place before a discharge has fully taken place through the leak resistors $R_2$ and $R_4$. This advances the timing at which the thyristor SCR is triggered, thereby advancing the ignition timing.

A further increase in engine speed causes an increase in the residual electric charge in the second capacitor $C_3$ to occur because the charging voltage of the first capacitor $C_2$ rises in proportion to the engine speed. Thus, the voltage of the second capacitor $C_3$ reaches a trigger level when the next following generating voltage $V_1$ of a small value is produced. Thus, the voltage of the second capacitor $C_3$ has a wave form ③ shown in FIG. 4, and thereafter the ignition timing is kept constant even if the engine speed shows a further increase.

When the engine speed decreases, the ignition system according to the invention operates in a process which is the reverse of the process described hereinabove by referring to the drawings.

What is claimed is:

1. An ignition system for an internal combustion engine, comprising:

CDI magnet means comprising a generating coil for generating electricity, an ignition capacitor charged by the generating coil for storing the electricity generated by the latter, and an ignition coil including a primary winding which receives a supply of the electric charge of the ignition capacitor as the latter discharges when a signal is supplied to a gate of a thyristor; and signal generating means comprising a signal coil, a first capacitor and a second capacitor and constituting a gating circuit of the thyristor, said signal coil supplying a signal to the first capacitor to charge same, the electric charge stored in the first capacitor being passed through a constant current circuit to the second capacitor to charge same, said second capacitor discharging through leak resistors, whereby a signal is supplied through transistors to the gate of the thyristor when the voltage of the second capacitor reaches a predetermined level.

* * * * *